US006119358A

United States Patent [19]

Haensch

[11] Patent Number: 6,119,358

[45] Date of Patent: Sep. 19, 2000

[54] METHOD AND DEVICE FOR MONITORING THE THICKNESS OF CONTINUOUSLY CONVEYED FLAT OBJECTS

[75] Inventor: Egon Haensch, Wetzikon, Switzerland

[73] Assignee: Ferag AG, Hinwil, Switzerland

[21] Appl. No.: 09/132,705

[22] Filed: Aug. 12, 1998

[30] Foreign Application Priority Data

Aug. 15, 1997 [CH] Switzerland ..... 01 922/97

[51] Int. Cl.[7] ..... G01B 5/06; G01B 5/04; B65H 5/14

[52] U.S. Cl. ..... 33/783; 271/262; 271/265.04

[58] Field of Search ..... 33/783, 791, 501.02, 33/501.05; 356/381; 270/52.02, 52.04, 52.06; 271/259, 262, 263, 265.01, 265.02, 265.03, 265.04

[56] References Cited

U.S. PATENT DOCUMENTS

| | | | |
|---|---|---|---|
| 4,279,079 | 7/1981 | Gamberini et al. | 33/783 |
| 4,473,951 | 10/1984 | Golinelli et al. | 33/783 |
| 4,493,153 | 1/1985 | Esken | 33/783 |
| 4,549,207 | 10/1985 | Boshier | 356/381 |
| 4,697,246 | 9/1987 | Zemke et al. . | |
| 4,710,808 | 12/1987 | Hoogenboom et al. | 356/381 |
| 4,941,269 | 7/1990 | Mori et al. | 33/783 |
| 5,447,240 | 9/1995 | Makino | 271/263 |
| 5,568,917 | 10/1996 | Buschhaus et al. . | |
| 5,647,588 | 7/1997 | Stauber et al. | 271/265.04 |
| 5,649,588 | 7/1997 | Lee . | |

*Primary Examiner*—G. Bradley Bennett
*Attorney, Agent, or Firm*—Birch, Stewart, Kolasch & Birch, LLP

[57] ABSTRACT

A device and method for monitoring the thickness of printed products which are conveyed by one conveying means each in a continuous conveying stream along a conveying direction. Monitoring elements are introduced into the conveying stream and one monitoring element is allocated to each printed product. The monitoring elements include a pair of monitoring levers with clamping jaws which are pressed against each other with a clamping force. During monitoring, a region of each printed product is clamped between the clamping jaws of a pair of levers which are pressed against each other. Pairs of one monitoring element and one printed product interact with each other and are conveyed in succession through a monitoring area. For quantitative recording of this interaction, an image is recorded of one edge of each of the monitoring levers of one lever pair, and of the distance between these edges. The distance is a function of the thickness of the pressed printed product. From this image, a measured value corresponding to the distance is determined. The measured value is compared with a reference range allocated to each monitoring element. The reference range is determined according to reference value determined by calibration, and a predetermined tolerance range, whereby a calibration is carried out for each control element using a product with a known, correct thickness.

20 Claims, 4 Drawing Sheets

METHOD AND DEVICE FOR MONITORING THE THICKNESS OF CONTINUOUSLY CONVEYED FLAT OBJECTS

BACKGROUND OF THE INVENTION

The invention concerns a monitoring method and a device for carrying out the monitoring method. The monitoring method and the device serve for monitoring the thickness of continuously conveyed, flat objects, in particular of printed products. With the inventive method it is possible to e.g. monitor the number of pages of printed products, to distinguish between products with correct and products with incorrect numbers of pages and to initiate corresponding further treatment.

In order to detect individual pages being missing or superfluous in printed products possibly having very different thicknesses by means of thickness measurement, a measuring accuracy of less than one tenth of a millimeter is necessary whereby the total thickness of the products may vary from below one millimeter to a few centimeters.

Known systems for measuring the thickness of continuously conveyed printed products often work with a contact-sensor which presses a printed product to be measured against the support on which the printed product lies for being conveyed, whereby the distance between contact-sensor and support is measured directly or indirectly. In order to achieve a measuring accuracy as mentioned above using contact-sensors and distance measurement the participating mechanical parts must be produced and assembled to a very high degree of precision. This is especially important if the contact-sensor belongs to a measuring system and the support to a conveying system and if, due to high conveying speeds and conveying performance, a large number of contactsensors and an even larger number of supports is used.

In the publication EP-651231 (F362) such a system is described. The measuring system substantially consists of a rotating disc with several pairs of contact-sensors which e.g. co-operate with the saddle-shaped supports of a gathering drum (conveying system). The disc and the gathering drum are arranged and synchronized relative to each other such that each support and the printed product conveyed on it is contacted by one pair of contact-sensors. The difference between the measuring positions (support without and with product) of the two contact-sensors corresponds to the thickness of the contacted product. These measurements are very sensitively dependent not only on the relative arrangement of the contact-sensors of each pair and on the relative arrangement of the two sensor arrangements for measuring the positions of the contact-sensors, but also on the arrangement of the supports. In order to achieve a sufficiently long measuring time, the contact-sensors must be movable relative to the disc and their additional movement superimposed on the circular movement of the disc must be controlled by corresponding control means. For elimination the influence of many mechanical tolerances on such a measurement, calibration, i.e. measurement without printed products on the supports, is necessary for each combination of contact-sensor pair and support in addition to the support measurements carried out with each thickness measurement and each thickness measurement is to be corrected according to the calibration. For keeping the number of calibration measurements within sensible limits the number of supports is to be an integer multiple of the number of contact-sensor pairs.

It is an object of the invention to provide a method for monitoring the thickness of flat objects, in particular of printed products, which flat objects are conveyed continuously by one conveying means each and to create a device for carrying out the method. The inventive method and the inventive device are to be independent of the conveying device to a considerably higher degree than this is the case in known devices. This means that the inventive thickness monitoring is not to enforce substantial mechanical constraints and increased accuracy on the conveying system. In spite of the necessary high resolution (paper thickness in the region of 0.1 mm, thickness of product up to several cm), the device is to be realizable using simple mechanical means and production and assembly tolerances easily achieved. The device is to be robust and to need little adjustment, i.e. it is to have characteristics which guarantee operation without problems in the dusty climate of printing works.

SUMMARY OF THE INVENTION

For carrying out the inventive method, monitoring elements are introduced into the conveying stream in which the printed products are conveyed continuously each by one conveying means (e.g. grippers), one monitoring element being allocated to each printed product. The monitoring elements substantially consist of a pair of monitoring levers with clamping jaws (first lever parts) which are pressed against each other. For thickness monitoring, a region of a printed product is clamped between the clamping jaws of the lever pair. The monitoring element and the printed product travel through a monitoring area in clamping interaction with each other. In this monitoring area, an image is taken of one edge (second lever parts) of each monitoring lever and of the distance between these edges. This image quantitatively representing the clamping interaction is recorded, whereby the distance on the image varies with the thickness of the clamped printed product. From the recorded image a measuring value corresponding to the distance between the edges is determined. This value is compared with a reference range allocated to each monitoring element. The reference range is a predetermined tolerance range which is allocated to a reference value originating from a calibration, whereby the calibration is carried out for each monitoring element using a product with a correct thickness.

Instead of recording an image and determining a measuring value from the image, other methods for determining a distance between the second lever parts may be used also.

As is yet to be shown, one interaction of each monitoring element with a printed product having a defined correct thickness is sufficient for determining the reference value. For the thickness variations caused e.g. by varying paper quality, varying temperature or varying humidity affecting the monitoring as little as possible, the reference value is advantageously constantly adapted to the most recent measurements, whereby for this kind of adaptation only monitoring cycles of objects with a thickness found correct are considered.

The tolerance range is to be predetermined corresponding to the monitoring purpose. For e.g. detecting and separately further treating printed products having an incorrect number of pages, the tolerance range is to be adjusted to the quality of the paper (paper thickness). On either side of the reference value, the tolerance range is to be smaller than the thickness of one page. For being able to detect the exact number of missing or superfluous pages, a plurality of corresponding tolerance ranges is superimposed, the tolerance ranges having different positions relative to the reference value (larger or smaller than the reference value) and/or different widths.

The only condition which the method according to the invention lays upon the conveying system for continuous conveying of the printed products consists in the printed products having to be conveyed by one conveying means each such that a region of each printed product is accessible for the monitoring levers from both sides and can be clamped between the clamping jaws.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The inventive method and an exemplified embodiment of the inventive device are described in more detail by means of the following Figures, whereby

FIG. 1 shows an overview of an embodiment of the inventive device. The device is shown as viewed perpendicular to the conveying direction F of the printed products 1. The printed products 1 are conveyed individually with the help of grippers 2 which are e.g. arranged on a chain running in a chain channel 2.1. The inventive device, in the shown exemplified case, substantially consists of a rotating monitoring disc 3 arranged such that the conveying direction F forms a tangent on it, being rotated (arrow R) in the direction of F and being equipped with monitoring elements 4, of a camera 5, of a computer for image and measured-value processing and of a triggering device 7.

Figure 1:
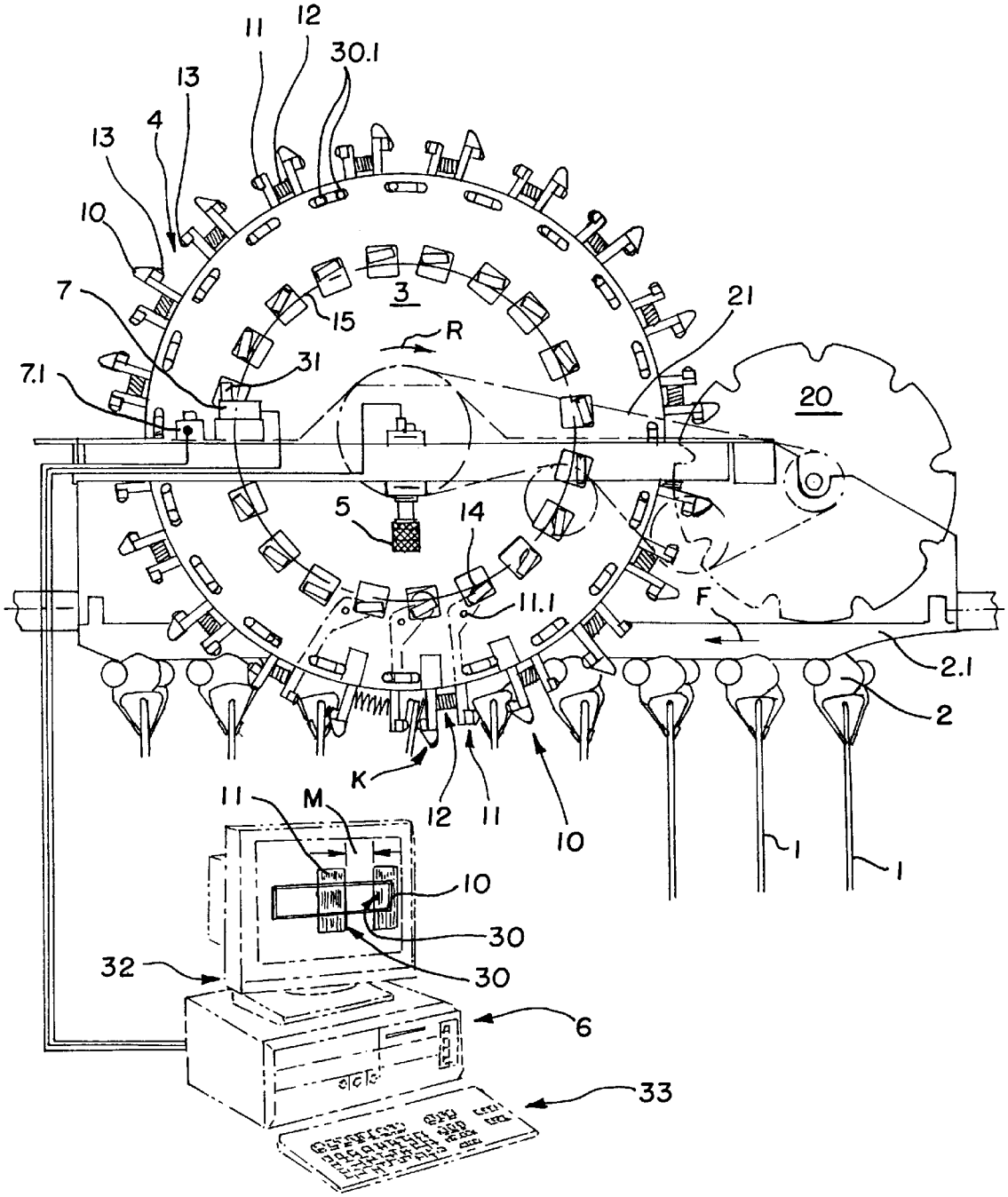
FIG. 1 shows an overview over an exemplified embodiment of the inventive device (viewed at an angle perpendicular to the conveying direction)

The monitoring elements 4 are arranged equidistantly on the circumference of the monitoring disc and substantially consist each of a monitoring lever 10 being stationary relative to the monitoring disc 3 and a monitoring lever 11 being movable relatively to the monitoring disc 3, e.g. being pivotal on an axis 11.1. Both monitoring levers 10 and 11 have a clamping jaw 13 on their distal ends, whereby the two clamping jaws 13 of one monitoring element 4 are directed towards each other and are aligned for the clamping of a printed product. By means of a spring 12, the pivotal monitoring lever 11 of each monitoring element 4 is pressed against the stationary monitoring lever 11, i.e. into a position in which the clamping jaws 13 are substantially touching or are clamping a printed product between them.

The pivotal monitoring lever 11 further comprises a control roll 14 which rolls on a stationary template 15 when the monitoring disc 3 rotates. The template 15 is designed such that the pivotal monitoring lever 11 is held at a distance from the stationary lever against the force of spring 12, except in the monitoring area K in which the monitoring element 4 is in interaction with a printed product 1. In this region the control roll 14 does not roll on the template 15 but its position is determined by the spring 12 and by the thickness of the printed product 1 clamped between the clamping jaws.

In order to guarantee smooth running of the monitoring disc it can possibly be advantageous to design the control template such that the clamping jaws of the individual monitoring elements are not quite touching when being moved through the monitoring area without a clamped printed product but are positioned at a distance from each other, whereby this distance is smaller than the thickness of the thinnest printed product to be expected.

The monitoring disc 3 is driven e.g. by a chain drive with a chain wheel 30 and a chain 21 to rotate in the same direction and in synchronism with the gripper chain (direction indicated by arrow R), whereby the monitoring disc 3 and the gripper chain are synchronized such that each gripper 2 is moved through the monitoring area K together with a monitoring element 4.

The camera 5 is arranged stationary and directed towards the monitoring area K. The direction of view of the camera 5 is, in the present exemplified case, substantially perpendicular to the rotation axis of the monitoring disc 3 and facing two edges 30 (FIG. 2) to be imaged which edges are arranged on parts 30.1 of the monitoring levers 10 and 11 protruding from the monitoring disc 3. The distance between the edges to be imaged is directly dependent on the thickness of a printed product 1 clamped between the clamping jaws 13. The camera 5 is e.g. a digital camera which creates a pixel file and transmits this to a computer 6.

For triggering the camera, a triggering device 7 is provided. This e.g. consists of a laser barrier which is disrupted by a reference body 31 arranged on each monitoring element 4, e.g. on the pivotal monitoring lever 11 and protruding from the monitoring disc 3 like the surfaces with the edges 30 to be imaged. The laser barrier of the triggering unit 7 is positioned such that in the moment in which the reference body 31 of a monitoring element interrupts it another monitoring element enters the monitoring area K and the camera 5 is to be triggered. The camera 5 is triggered by the signal of the interrupted laser barrier.

Furthermore, a switch 7.1 may be provided which switch is triggered by one of the elements arranged on the monitoring disc 3, the element activating the switch once in each revolution of the monitoring disc. The signal of the switch 7.1 is e.g. used for resetting to zero a counter counting the monitoring actions and allocating each monitoring action to a specific monitoring element or allocating to the monitoring action the specific reference value of the specific monitoring element respectively.

The computer 6 serves for evaluating the images containing the distance between the edges 30 of the stationary monitoring lever 10 and the pivotal monitoring lever 11 (visible on screen 32 of computer 6), i.e. for measuring the distance contained on the image (measured value M). The measured value M is e.g. recorded as a number of pixels. Furthermore, the computer serves for storing and possibly for continuously adapting the reference values of which one is allocated to each monitoring element. For the input of e.g. tolerance ranges, the computer 33 is also equipped with a keyboard 33.

Figure 2:
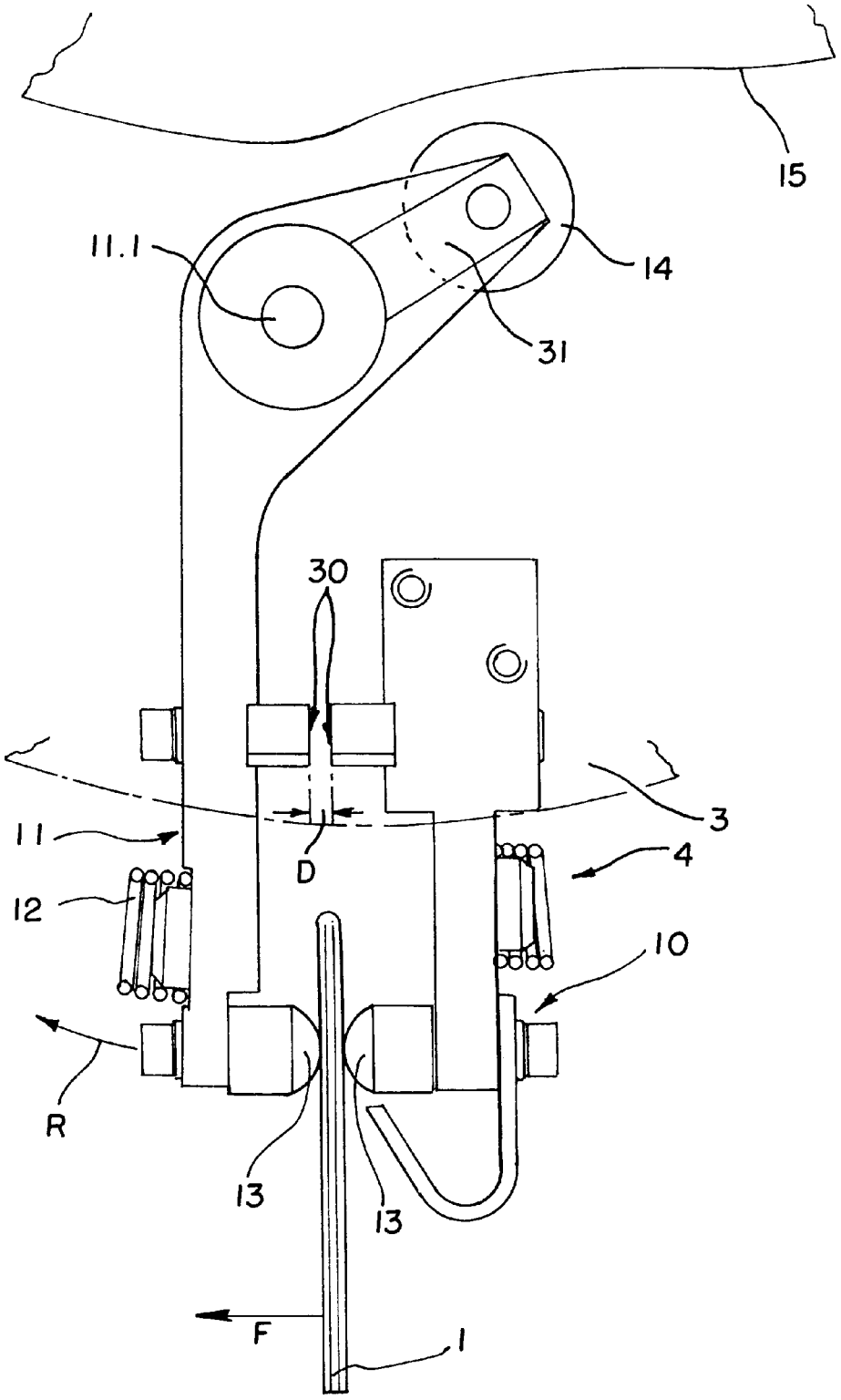
FIG. 2 shows a monitoring element with a clamped printed product viewed perpendicular to the conveying direction.

FIG. 2 shows a monitoring element 4 in more detail viewed in a direction parallel to the rotation axis of the monitoring disc 3, i.e. perpendicular to the conveying direction F. The monitoring element 4 is shown in the monitoring area, i.e. in clamping interaction with a printed product 1. In this area, the template 15 correspondingly deviates from the circular form concentric with the monitoring disc 3, which it has in all other areas. Therefore, in the monitoring area, the control roll 14 does not touch the control template 15 and the clamping jaws 13 are able to clamp the printed product 1. The value to be measured is the distance D between the edges 30.

Figure 3:
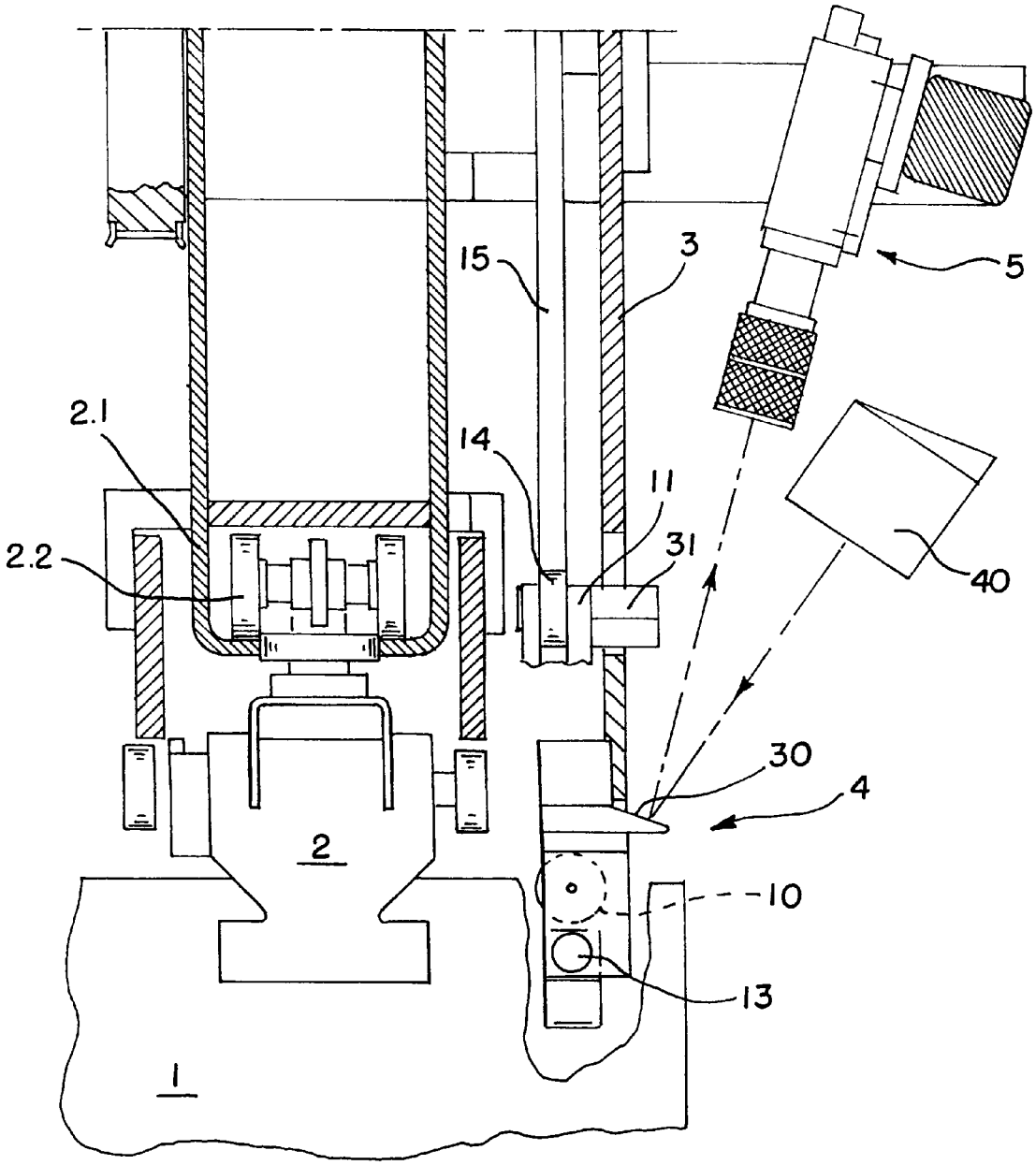
FIG. 3 shows parts of a monitoring element and a printed product to be monitored in the monitoring area, viewed against the conveying direction.

FIG. 3 shows, viewed in a direction opposite to the conveying direction F, a gripper 2 driven by means of a gripper chain 2.2 in a chain channel 2.1 and conveying a printed product. The Figure shows a part of the monitoring disc 3 with parts of a monitoring element 4, the camera 5 and a lighting or flashlight device 40. The stationary monitoring lever 10 of the monitoring element 4 and in particular the surface forming the edges 30 are fully visible. The control roll 14 and the reference body 31 are the parts of the monitoring lever 11 which are visible. The monitoring element 4 has obviously not yet reached the monitoring area or has just left it, as the control roll 14 rolls on the template 15.

The operation of the inventive device according to FIGS. 1 to 3 is as follows:

A printed product 1 is conveyed towards the monitoring area K. Shortly before it reaches the monitoring area K, a monitoring element 4 is introduced into the conveying stream of the printed products, the monitoring element being in an open condition (clamping jaws at a distance from each other) such that the two clamping jaws 10 and 11 can be positioned on opposite sides of a free region of the printed product. At the entrance of the monitoring area K, the action of the template 15 on the pivotal monitoring lever 11 ends and the pivotal monitoring lever is driven towards the stationary lever 10 by the spring 12 such that the free region of the printed product 1 is clamped between the pressing jaws 13 of the monitoring levers 10 and 11. Interacting in this manner, the monitoring element 4 and the printed product 1 move through the monitoring area K together. At the same time, the camera 5 is triggered by the triggering unit 7 and an image of the edges 30 and of the distance D between them is recorded. Immediately afterwards, the pivotal monitoring lever 11 is again moved away from the stationary monitoring lever 10 by the effect of the template 15 and thus the printed product 1 is released from the clamping action. The monitoring region K amounts to a few arc minutes of the rotation of the monitoring disc 3.

The image recorded by the camera 5 is processed by the computer 6. This processing substantially consists in producing a measured value M (e.g. in pixels) proportional to the real distance D between the imaged edges 30. This measured value M is compared with a reference range $M_S \pm T$ ($M_S$=reference value, T=tolerance range). If the measured value M is within the reference range the product is judged as correct and no further measures are taken. If the measured value M is outside of the reference range the product is judged as faulty and a signal is generated by the computer 6 which signal e.g. activates an alarm device or is used for controlling a device for eliminating the faulty product from the product stream (e.g. by opening the corresponding gripper 2 over a waste container).

The measured value M is not identical with the thickness of the clamped printed product. Apart from this thickness the following factors are contained in the measured value M: multiplicative factors caused by the enlargement or diminution of the recorded image and by inaccuracies in the distance between the clamping jaws and the edges (lever ratio) to be imaged and additive factors caused by inaccuracies in the mutual arrangement of the edges to be imaged (D without clamped printed product possibly not equal zero). For the named factors not to influence the monitoring it is absolutely necessary to determine a reference value $M_S$ for each monitoring element 4 separately and to store it.

As mentioned earlier the reference value $M_S$ is determined for each monitoring element by means of a calibration, i.e. a monitoring process with a correct product (having the correct number of pages k) is carried out and the corresponding measured value $M_k$ is stored as reference value $M_S$ for at least one further monitoring process with the same monitoring element. A tolerance T is allocated to the reference value $M_S$ which tolerance corresponds to a predetermined fraction of the thickness of one page (paper thickness) in the same scale in which the measured value $M_S$ corresponds to the actually considered distance D. Tolerance T is keyed in and does not change as long as products with the same paper quality are monitored.

For monitoring printed products which are supposed to have all the same number of pages (k), one first monitoring procedure for each monitoring element and with printed products defined as correct is sufficient for the determination of all the reference values $M_S$. If the monitoring is to be carried out on products with different page numbers a reference value $M_{Ss}$ is to be calculated for each product using the numbers of pages the product is supposed to have. For eliminating the effect of additive factors as named above on such a calculation, a second calibration without printed products and a measured value $M_0$ is necessary in addition to the calibration with products of a known reference number r of pages and measuring values $M_r$.

The condition to be fulfilled by a correct product is then:

$$M=M_{Ss}\pm T, \text{ whereby } M_{Ss}=(s/r)(M_r-M_0)$$

Normally the variations between the multiplicative factors for the individual monitoring elements 4 will not be so large that the same tolerance range could not be used for all monitoring elements. With very sensitive monitoring, however, this must be examined separately.

The reference value $M_s$ or $M_{Ss}$ is advantageously adapted to long wave variations of measured values M which can e.g. be caused by variations in the ambient conditions (temperature, air humidity). This can e.g. be realized with the following algorithm: If a product is considered a correct product (measured value M within the reference range) the reference value $M_s$ is adapted for the next monitoring process with the same monitoring element by a corresponding additive correction term having little weight only (e.g. 5%), i.e.:

$$M'_S=0.95\cdot M_S+0.05\cdot M$$

Whereby $M'_s$=new reference value $M_S$=old reference value

M=present measured value

The small weight of the correction term prevents short wave variations of the reference value.

Figure 4:
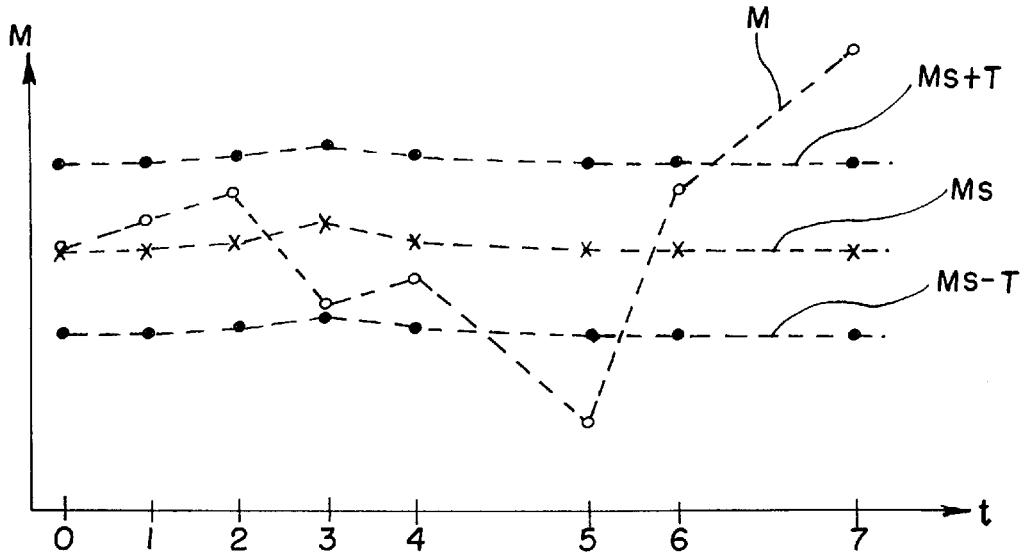
FIGS. 4 and 5 show two exemplified diagrams of measuring results of the inventive method.

FIG. 4 shows a possible course of monitoring processes carried out by one monitoring element. The measured values M are shown versus the time t. The varying time intervals between the monitoring processes 1 to 7 are due to a varying conveying speed. FIG. 4 shows the course of the reference value and tolerance range by adaptation to the measured values M. In the fifth and seventh monitoring process, faulty products are detected and for this reason the reference value is not corrected.

Figure 5:
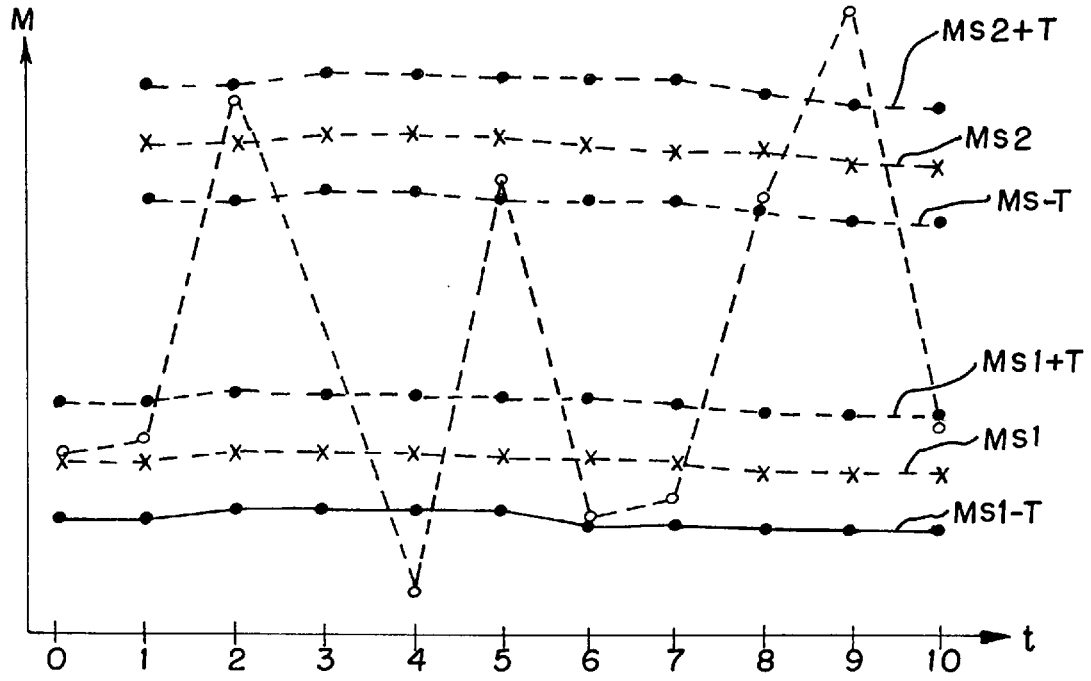

FIG. 5 shows monitoring with two reference ranges $M_{S1}\pm T$ and $M_{S2}\pm T$ which e.g. differ from each other by the thickness of four pages. The first reference range corresponds e.g. to a printed product without a four-page-supplement, the second reference range to a printed product with a four-page-supplement. If the correct presence of the supplement is monitored by another monitoring method, the thickness-monitoring detects products (with or without supplement) having faulty page numbers, by judging products for which the measured value is within one of the two reference ranges as correct and products for which the measured values is not in one of the two reference ranges as incorrect. Thereby, a product with four superfluous pages but without supplement is wrongly judged as being correct. For eliminating such faults, the composition (with or without supplement) of each product is transmitted to the computer carrying out the calculations necessary for the thickness-monitoring such that it uses the one applicable reference range only.

Of the two reference values $M_{S1}$ and $M_{S2}$ either both are determined by corresponding calibration or one of them may be determined by calculation if the paper quality of the printed product and of the supplement are the same.

FIG. 5 shows ten successive monitoring procedures, whereby the monitoring procedure denominated with zero is the calibration with a printed product without supplement and whereby in the monitoring procedures 1, 6, 7 and 10 correct products without supplement are detected, in the monitoring procedures 2, 5, 8 correct products with supplement are detected and in the monitoring procedures 3, 4 and 9 faulty products are detected. Here again, the shown monitoring procedures relate to one specific monitoring element and the reference values are only adapted after detection of a correct product.

In both FIGS. 4 and 5, adaptation of the reference value is shown in a much exaggerated way.

FIGS. 1 to 3 show an exemplified embodiment of the inventive device and also of the inventive method. Possible variants of this embodiment are e.g.:

The printed products 1 are not conveyed along a straight line but along a curved line.

The monitoring elements 4 are nor arranged on a monitoring disc but on an endless chain the course of which is adapted to the course of the conveying direction F at least in the monitoring area.

The printed products 1 are not conveyed equidistantly but by individual conveying means of which each drives a monitoring element out of a corresponding buffer and conveys it through the monitoring area (K).

The printed products 1 are not conveyed in a direction perpendicular to their main surfaces but in a direction e.g. parallel to their main surfaces and the monitoring elements 4 are arranged on the monitoring disc 3 turned by 90° compared with the arrangement as shown.

The template 15 extends only over the areas in which the monitoring elements 4 are introduced into the conveying stream of printed products 1 and guided out of it again.

Both monitoring levers 10 and 11 are arranged movably on the monitoring disc 3.

The distance between the edges 30 is not determined by means of imaging but by direct measurement (e.g. capacitive distance measuring).

The triggering device 7 is arranged in the monitoring area K and co-operates with each monitoring element entering the monitoring region K.

The products to be monitored are conveyed at a constant conveying speed and the triggering device is a clock unit.

For monitoring printed products which contain small supplements (e.g. postcards) two inventive devices are used which monitor different portions of the printed products.

The inventive device is connected, via software, to similar devices in different processing stages or to monitoring systems of different kinds.

The above list is not complete and can be extended by one skilled in the art without deviating from the basic idea of the inventive method or the inventive device.

Obviously, the inventive method and the inventive device are not only applicable for monitoring printed products in regard to missing or superfluous pages. In the same manner they are applicable for detecting folded-in or crumpled-up pages or for monitoring the quality of paper if the printed products to be monitored consist of one page only or if their number of pages has already been judged correct by another means (e.g. by corresponding monitoring of the steps in which these pages have been assembled). As mentioned above, the inventive method and the inventive device are also applicable for monitoring the thickness of other flat objects. For each case of application the width of the tolerance range is to be determined.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for monitoring the thickness of objects conveyed along a conveying stream, the method comprising:

moving a plurality of monitoring elements through a closed path, the monitoring elements moving in succession through a monitoring area, each monitoring element having two monitoring levers;

moving a plurality of objects in succession through the monitoring area, the objects moving through the monitoring area such that each object interacts with one of the monitoring elements to form an interacting pair while in the monitoring area, each interacting pair being formed when first parts of the monitoring levers of a monitoring element press a region of a corresponding one of said objects therebetween;

determining a distance between second parts of the monitoring levers that form part of an interacting pair within the monitoring area;

generating a reference value of said distance for each monitoring element, the reference values being determined by calibrating the monitoring elements with an object of known thickness;

comparing the determined distance corresponding to an object in an interacting pair moved through the monitoring area with the reference value of the monitoring element of the interacting pair; and generating a control signal as a function of the result of each comparison between a determined distance and a reference value when a control condition is satisfied.

2. The method of claim 1, wherein the objects are printed products.

3. The method of claim 1, wherein the step of determining said distances corresponding to the objects includes the step of imaging the second parts of the monitoring levers of a monitoring element.

4. The method of claim 1, wherein the step of generating a reference value includes the step of determining a tolerance range, wherein when a determined distance lies outside the tolerance range the control condition is satisfied and a control signal is generated.

5. The method of claim 4, wherein the control signal indicates that the object measured is faulty.

6. The method of claim 4, wherein the objects are printed products, the tolerance range corresponding to a fraction of the thickness of an individual page of the printed products to be monitored.

7. The method of claim 4, wherein the reference value of each monitoring element is adapted in accordance with a function of the determined distance corresponding to an object associated with said monitoring element as it moves through the monitoring area, the adapting taking place on the condition that the determined distance lies within the tolerance range associated with the monitoring element.

8. The method of claim 7, wherein reference values are adapted by an additive correction term, the additive correction term being a weighted value of the determined distance corresponding to an object associated with said monitoring element as it moves through the monitoring area.

9. The method of claim 2, wherein a reference value for each monitoring element is generated for each printed product to be monitored.

10. The method of claim 9, wherein individual reference values for printed products having differing numbers of pages are calculated as a function of a calibration of each monitoring element which is not interacting with a printed product, and a calibration of each monitoring element interacting with a reference number of pages.

11. A device for monitoring the thickness of objects conveyed along a conveying stream, the device comprising:

a plurality of monitoring elements, each monitoring element including a pair of monitoring levers, each lever having a pressing surface with the pressing surfaces of the pair of monitoring levers being opposed to one another, the monitoring elements being movable in succession along a closed course into and out of conveying stream of objects to be monitored, the monitoring elements being movable in synchronism with the stream of objects such that a monitoring element and an associated object form an interacting pair while in a monitoring area, with a region of the object held between the pressing surfaces;

a sensor for detecting a distance between respective parts of the pairs of monitoring levers of a monitoring element, the distance between the respective parts being related to a thickness of an object held between the pressing surfaces of the pair of monitoring levers when the monitoring element and the object form an interacting pair;

a control device, the control device being adapted to compare the distance detected by the sensor with a reference value associated with the respective monitoring element; and a triggering device, the triggering device activating the sensor when a monitoring element enters the monitoring area, wherein each monitoring element has an associated reference value for comparison with the distance value detected by the sensor.

12. The device of claim 11, wherein the sensor is an imaging camera, the imaging camera being arranged to image edges of and the distance between the edges of the monitoring levers of the monitoring elements.

13. The device of claim 11, wherein the device comprises a rotatable monitoring disc, the monitoring elements being arranged equidistantly on the monitoring disc, and the monitoring disc being driven to move the monitoring elements in sychronism with the objects.

14. The device of claim 13, wherein one of the monitoring levers of each of the monitoring elements is rigidly connected to the monitoring disc and the other lever is pivotably mounted on the monitoring disc.

15. The device of claim 14, further comprising a stationary template, one of the monitoring levers of each of the monitoring elements including a control roll selectively engageable with the stationary template, wherein when a monitoring element exits the monitoring area its control roll interacts with the stationary template to hold the monitoring levers distanced from one another.

16. The device of claim 15, wherein each monitoring element includes a spring, the spring being provided between the pivotal monitoring lever of the monitoring element and the stationary monitoring lever of an adjacent monitoring element.

17. The device of claim 11, wherein the triggering device includes a laser barrier, the triggering device sensing a monitoring element entering the monitoring area when a reference body of the monitoring element crosses the laser barrier.

18. The device of claim 12, wherein the imaging camera is a digital camera.

19. The device of claim 11, wherein the control device is adapted to distinguish objects having a thickness that lies outside of a tolerance range.

20. The device of claim 11, wherein the distance between the respective parts is directly proportional to a thickness of an object held between the pressing surfaces of the pair of monitoring levers when the monitoring element and the object form an interacting pair.

* * * * *